United States Patent [19]

Muz

[11] 4,324,198

[45] Apr. 13, 1982

[54] DEVICE FOR THE ELECTROSTATIC APPLICATION OF MATERIAL PARTICLES ENTRAINED IN A STREAM OF GAS TO AN ADVANCING, FLAT SUBSTRATE

[75] Inventor: Edwin Muz, Reutlingen, Fed. Rep. of Germany

[73] Assignee: Weitman and Konrad GmbH & Co. KG, Fed. Rep. of Germany

[21] Appl. No.: 179,804

[22] Filed: Aug. 20, 1980

[30] Foreign Application Priority Data

Sep. 12, 1979 [DE] Fed. Rep. of Germany ..... 2936754

[51] Int. Cl.[3] ..... B05B 5/02

[52] U.S. Cl. ..... 118/630; 118/627; 118/629; 118/636; 427/39; 427/32; 427/41

[58] Field of Search ..... 427/39, 41, 32; 118/627, 629, 630, 636

[56] References Cited

U.S. PATENT DOCUMENTS 3,000,752 9/1961 Jackson et al. ..... 427/39 X
3,868,925 3/1975 Smith et al. ..... 118/630 X
3,976,031 8/1976 Itoh ..... 118/629
4,011,991 3/1977 Masuda ..... 118/629 X

FOREIGN PATENT DOCUMENTS 2646798 4/1978 Fed. Rep. of Germany .

*Primary Examiner*—Shrive P. Beck
*Attorney, Agent, or Firm*—Kenway & Jenney

[57] ABSTRACT

A device for the electrostatic application of particles entrained in a stream of gas to a non-conductive, flat substrate, typically a web or sheets of paper. The particles are electrically neutral in the stream. A charging electrode is located below the substrate in the area where the gas stream impinges on the substrate. The substrate is advancing lengthwise, and a counterelectrode is located below the substrate in the direction of advance from the charging electrode. Preferably the direction and velocity of the gas stream near the substrate and direction and velocity of the substrate itself are approximately equal. Also in the preferred form, a grounded collecting pan is located beneath the electrodes.

3 Claims, 2 Drawing Figures

DEVICE FOR THE ELECTROSTATIC APPLICATION OF MATERIAL PARTICLES ENTRAINED IN A STREAM OF GAS TO AN ADVANCING, FLAT SUBSTRATE

BACKGROUND OF THE INVENTION

This invention concerns a device for the electrostatic application of material particles entrained in a stream of gas to an advancing, flat substrate in the form of webs or sheets, particularly made of paper, in printing machines or the like.

In a known device of this type (German Patent Disclosure No. 2,646,798), the charging of powder particles takes place in an air jet head, so that powder particles therefore leave this head with an electrical charge and are deflected to the substrate to be coated. The substrate to be coated is generally an electrically nonconductive material, such as paper or textile. In this case, a counterelectrode is located beneath the substrate to be coated with powder.

Aside from a frequently inadequate electrical charging of the powder particles in the jet head, the known device has the drawback that the particles already charged in the jet head are deflected not only towards the substrate but also towards the machine frame, where the powder is deposited and forms troublesome deposits. In particular, these deposits in the dusting of paper sheets or the like can also occur on the feed system transporting the sheets, consisting of clips or the like, whereby the feed system loses its operating capability. Frequent shutdowns of the machine are necessary for the purpose of cleaning. In addition, the powder material which has been deposited on the feed system or on the machine frame, ordinarily at ground potential, is not reusable and is lost for its intended purpose.

The purpose of this invention is to propose a type of device which leads to less soiling and a saving of powder material to be applied.

This purpose is accomplished pursuant to the invention by the following features:

(a) The gas stream carries electrically neutral material particles with it;

(b) beneath the advancing substrate, in the area of the point of impingement of the gas stream on the substrate, is located at least one charging electrode for the production of a corona discharge;

(c) at least one counterelectrode is located in the advance direction of the substrate at a distance from the charging electrode.

The core of the invention therefore consists of the fact that the particles to be applied obtain their electrical charge only in the immediate vicinity of the substrate and can then only deposit on the substrate practically exclusively, but not on the machine frame, feed system, or the like. In this way, a soiling of a printing press or the like is prevented, and a material saving of up to 50% can be achieved since the material to be applied is not deposited at other places.

The following description of preferred forms of embodiment of the invention provide further explanation in connection with the attached drawing.

Figure 1:
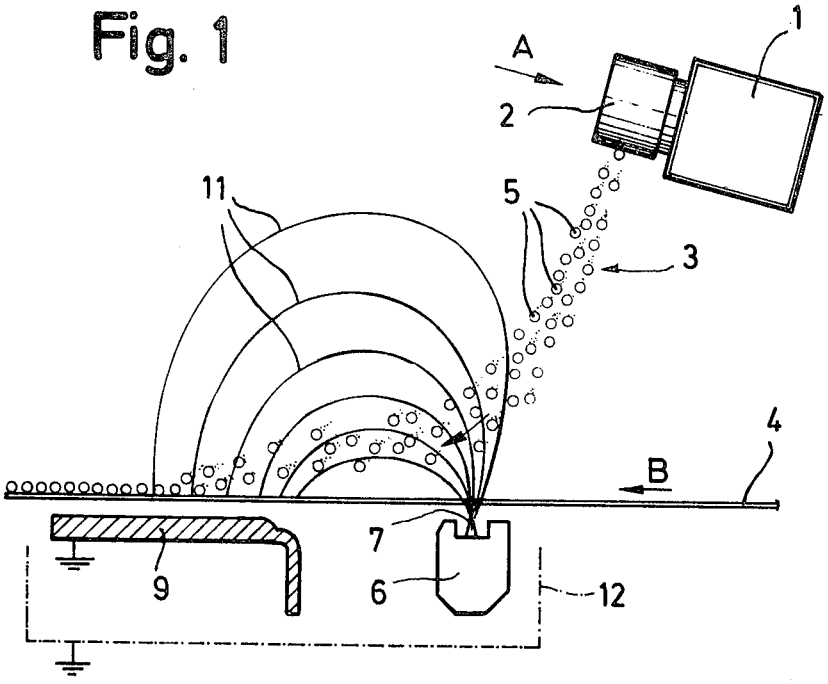
Figure 2:
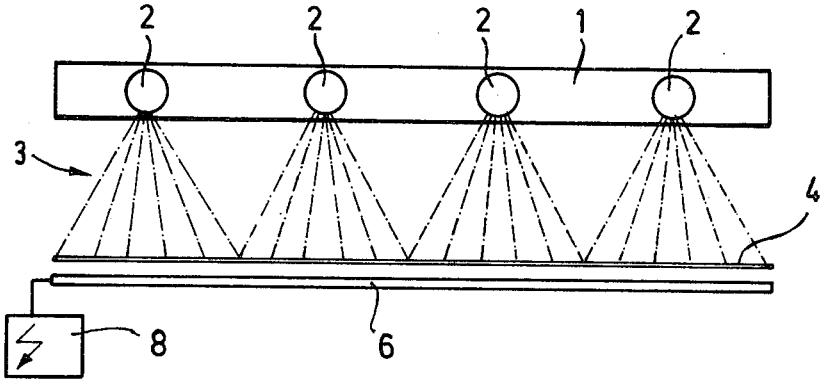

The drawings show:

FIG. 1: schematically, a device for the powdering of flat substrates with electrically charged powder particles in side view, and FIG. 2: schematically, a front view of the device from FIG. 1 in the direction of the arrow A.

In the illustrated device, several air jet heads 2, from which fan-shaped gas streams 3 exit diagonally downward onto a flat substrate 4 to be powdered are located in a known manner on a rod-shaped carrier 1 with compressed air and powder feeds, not illustrated. The substrate 4 can be in the form of webs or sheets, particularly of paper. It is moved forward in the direction of the arrow B with a specific speed of advance, for example up to 600 m/min in the direction of the arrow B. If individual sheets of paper are involved, which are to be printed in a printing press, these sheets are fed by a feed system which comprises, for example, endless conveyer chains and clips fastened to them to retain the sheets and carry them along.

As seen from FIG. 1, the gas stream in the area of its impingement on the substrate 4 is deflected in the direction of the advance motion (Arrow B). The exit velocity of the air from the jet head 2 and the speed of advance of the web 4 are so adjusted to one another that the two velocities are the same beyond the point of impingement of the powder particles on the substrate, so that no relative motion therefore takes place between the powder and the substrate.

Electrically uncharged, and therefore neutral, material particles 5 exit from the air jet head 2. Beneath the substrate 4 is located a rod-shaped charging electrode 6, well-known in itself, perpendicular to the direction of advance. The charging electrode 6, in the preferred form of embodiment of the invention, can have a number of points or knife edges 7 which point upward towards the substrate 4. The points or knife edges 7, cf. FIG. 2, are connected in a known way with a high-voltage electrical source, which leads to a nominal output voltage at the points or knife edges 7 of approximately 20–100 kV. The high voltage source 8 provides an electrical direct current voltage. In the advance direction, beyond the charging electrode 6, a grounded counterelectrode 9 is located beneath the substrate 4, at a distance.

A corona discharge passing through the (electrically insulating) substrate 4, whose field lines running towards the counterelectrode 9, are designated in FIG. 1 as 11, is formed at the points or knife edges 7 of the charging electrode 6. In this field, into which the particles 5 enter shortly before their impingement on the substrate 4, the particles are electrically charged by corona charging and contact charging, and cling firmly almost exclusively to the substrate, so that a substrate 4 uniformly coated with powder or the like is found beyond the counterelectrode 9.

It has been found, because of the circumstance that the electrically neutral material particles leaving the air jet head 5 receive their electrical charge only directly above the substrate 4, that practically no undesired material deposition takes place outside of the substrate, or particularly on the machine frame, feed system, or the like.

In FIG. 1, the counterelectrode 9 is in the form of a passive, grounded component. In another form of embodiment of the invention, it can also comprise several grounded metal rods which are in contact with the advancing substrate 4. The counterelectrode 9 can also have the form of an ionizing rod powered with separate voltage which is then not in contact with the advancing substrate 4. In the latter case, the counterelectrode can also produce a so-called passive corona discharge.

As indicated in FIG. 1 by broken lines, a pan 12 can be located beneath the charging electrode 6 and the counterelectrode 9, which serves to collect the excess powder or the like. The pan 12 consists of metal and is grounded. In the first instance, the powder collects in it which exits from the air jet heads 2 and flows laterally past a substrate 4 which is narrower than the carrier 1 and the charging electrode 6. If the substrate 4 consists of individual sheets transported at mutual intervals, the pan 12 also receives the powder material passing through the spaces between the individual sheets.

It is important in the device pursuant to the invention that the streams of air loaded with powder from the jet heads 2 impinges on the advancing substrate 4 in the region of action of the charging electrode 6, and that the direction of the air flow and the direction of advance of the substrate, as well as the mutual velocities, are so adjusted to one another that no relative motion takes place between the material particles 5 and the substrate 4 in the area of the point of impingement.

The electrostatically charged material is held fast to the substrate 4. Any excess residual charge can be eliminated completely by a final electrifier, well-known in itself, located beyond the counterelectrode 9.

The benefits obtainable through the invention are summarized once more below:

The material to be applied is deposited practically only on the substrate 4, but not on components of a printing press or the like. This produces a powder saving of up to 50%. Since only a small soiling of the machine takes place, because of the precise material application, the machine needs to be serviced and cleaned only at comparatively large time intervals. There are therefore fewer machine shutdowns. Since the machine causes less dirt when using a device pursuant to the invention, an environmentally compatible system is obtained overall.

I claim:

1. Device for the electrostatic application of particles emerging from a source and being entrained in a stream of gas to an advancing, flat substrate in the form of webs or sheets of electrically non-conductive material, the particles being deposited from the source above said advancing substrate, characterized by the following features:

(a) The stream of gas (3) carries electrically neutral material particles (5) with it;

(b) beneath the advancing substrate (4) in the area of the position of impingement of the gas stream on the substrate is located at least one charging electrode (6) for the production of a corona discharge;

(c) at least one counterelectrode (9) is located below said substrate in the direction of advance (B) of the substrate at a distance from the charging electrode (6).

2. Device pursuant to claim 1, characterized by the fact that the direction and velocity of the gas stream (3) in the region of the substrate (4) is approximately equal to the direction and velocity of said advance (B).

3. Device pursuant to claim 1, characterized by the fact that a grounded particle-collecting pan (12) is located beneath the electrodes (6, 9).

* * * * *